US011161340B2

(12) United States Patent
Saito et al.

(10) Patent No.: US 11,161,340 B2
(45) Date of Patent: Nov. 2, 2021

(54) LIQUID DISCHARGE APPARATUS

(71) Applicants: Shohei Saito, Kanagawa (JP); Yasuhiko Kachi, Kanagawa (JP)

(72) Inventors: Shohei Saito, Kanagawa (JP); Yasuhiko Kachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/896,020

(22) Filed: Jun. 8, 2020

(65) Prior Publication Data

US 2021/0023838 A1 Jan. 28, 2021

(30) Foreign Application Priority Data

Jul. 23, 2019 (JP) ..... JP2019-135227
May 20, 2020 (JP) ..... JP2020-088093

(51) Int. Cl.
*B41J 2/045* (2006.01)

(52) U.S. Cl.
CPC ..... *B41J 2/04563* (2013.01); *B41J 2/04531* (2013.01)

(58) Field of Classification Search
CPC ... B41J 2/04563; B41J 2/04531; B41J 29/377
See application file for complete search history.

(56) References Cited

U.S. PATENT DOCUMENTS 7,980,683 B2 * 7/2011 Bansyo ..... B41J 2/18 347/85
2005/0052513 A1 * 3/2005 Inoue ..... B41J 2/175 347/89
2005/0179715 A1 * 8/2005 Merz ..... B41J 2/04581 347/17
2016/0243826 A1 * 8/2016 Van Sas ..... B41J 2/04563
2016/0257113 A1 9/2016 Takeuchi et al.
2017/0173946 A1 6/2017 Yamanaka et al.

FOREIGN PATENT DOCUMENTS

JP 2009-262540 11/2009

* cited by examiner

*Primary Examiner* — Thinh H Nguyen
(74) *Attorney, Agent, or Firm* — Duft & Bornsen, PC

(57) ABSTRACT

A liquid discharge apparatus includes a plurality of heads configured to discharge a liquid, a liquid supply manifold configured to distribute the liquid to the plurality of heads, and a temperature-controlled liquid supply manifold configured to supply a temperature-controlled liquid to the plurality of heads. The temperature-controlled liquid supply manifold is thermally coupled to the liquid supply manifold.

15 Claims, 14 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-135227, filed on Jul. 23, 2019, and 2020-088093, filed in May 20, 2020, in the Japan Patent Office, the entire disclosure of each of which is hereby incorporated by reference herein.

BACKGROUND

Technical Field

The present disclosure relates to a liquid discharge apparatus.

Related Art

In a liquid discharge head of a liquid discharge apparatus, the temperature of a liquid to be discharged rises inherent to heat generated by, for example, a driver integrated circuit (IC) that drives a pressure generator to discharge the liquid. Due to the temperature rise, liquid discharge properties fluctuate. For example, a liquid whose temperature is controlled (i.e., a temperature-controlled liquid) is distributed to a plurality of heads to minimize such temperature rise.

SUMMARY

According to an embodiment of this disclosure, a liquid discharge apparatus includes a plurality of heads configured to discharge a liquid, a liquid supply manifold configured to distribute the liquid to the plurality of heads, and a temperature-controlled liquid supply manifold configured to supply a temperature-controlled liquid to the plurality of heads. The temperature-controlled liquid supply manifold is thermally coupled to the liquid supply manifold.

According to another embodiment of this disclosure, a liquid discharge apparatus includes a plurality of heads configured to discharge a liquid, and a manifold configured to distribute the liquid and a temperature-controlled liquid to the plurality of heads.

According to another embodiment of this disclosure, a liquid discharge apparatus includes a plurality of heads configured to discharge a liquid, a first liquid channel through which the liquid is distributed to the plurality of heads, and a second liquid channel configured to distribute a temperature-controlled liquid to the plurality of heads. The second liquid channel is thermally coupled to the first liquid channel.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
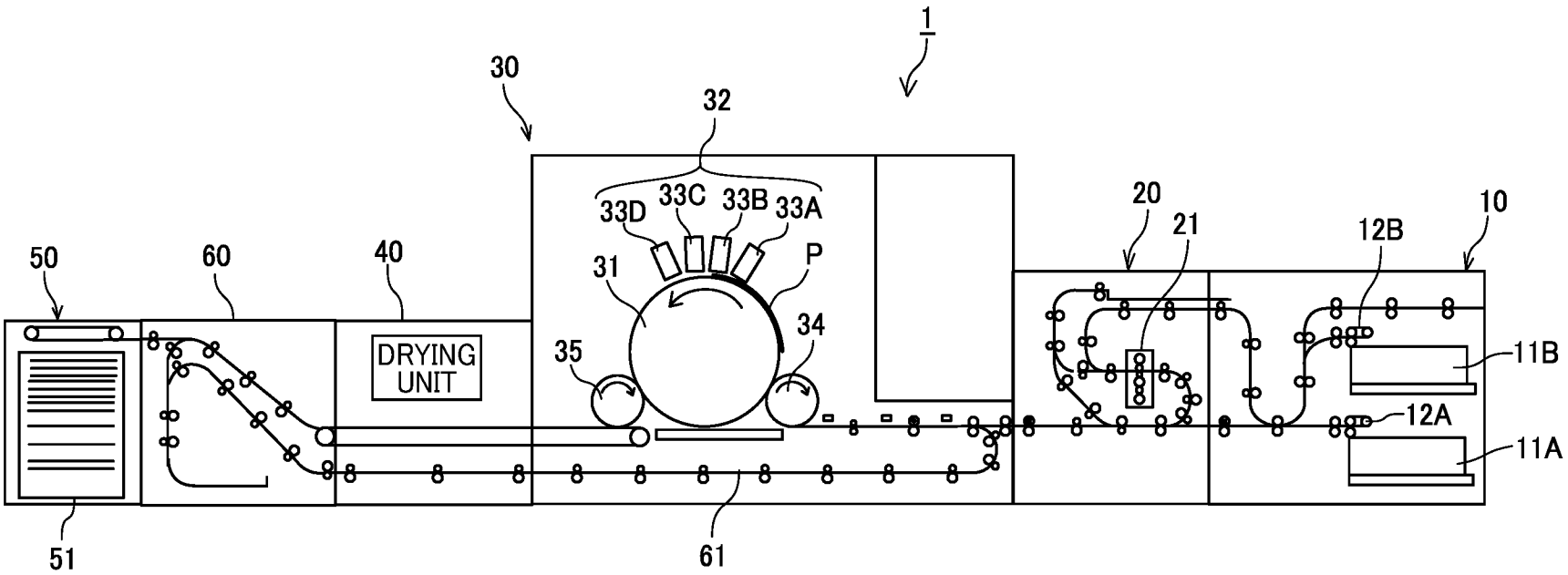
FIG. 1 is a schematic cross-sectional view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

A description is given of a printer as a liquid discharge apparatus according to a first embodiment of the present disclosure, with reference to FIG. 1. FIG. 1 is a schematic cross-sectional front view of the printer according to the first embodiment of the present disclosure.

A printer 1 includes a loading unit 10 to load a sheet P into the printer 1, a pretreatment unit 20, a printing unit 30, a drying unit 40, an unloading unit 50, and a reversing unit 60. In the printer 1, the pretreatment unit 20 applies, as required, a pretreatment liquid onto the sheet P fed (supplied) from the loading unit 10, the printing unit 30 applies a liquid to the sheet P, thereby performing printing, and the drying unit 40 dries the liquid adhering to the sheet P, after which the sheet P is ejected to the unloading unit 50.

The loading unit 10 includes a loading trays 11 (a lower loading tray 11A and an upper loading tray 11B) to store a plurality of sheets P, feeders 12 (12A and 12B) to separate and feed the sheets P one by one from the loading tray 11, and feeds the sheet P to the pretreatment unit 20.

The pretreatment unit 20 includes an application device 21 that coats an image formation surface of the sheet P with a treatment liquid having an effect of aggregating ink to prevent bleed-through.

The printing unit 30 includes a drum 31 (a rotator) to carry and convey the sheet P on an outer peripheral surface thereof and a liquid discharge device 32 to discharge the liquid toward the sheet P carried on the drum 31.

The printing unit 30 includes transfer cylinders 34 and 35. The transfer cylinder 34 receives the sheet P from the pretreatment unit 20 and forwards the sheet P to the drum 31. The transfer cylinder 35 receives and forwards the sheet P conveyed by the drum 31 to the drying unit 40.

The transfer cylinder 34 includes a sheet griper to grip the leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite the drum 31.

Similarly, the drum 31 includes a sheet gripper on the surface thereof, and the leading end of the sheet P is gripped by the sheet gripper. The drum 31 has a plurality of suction holes dispersedly on the surface thereof, and a suction device generates a suction airflow orienting inward from a predetermined suction hold of the drum 31.

On the drum 31, the sheet gripper grips the leading end of the sheet P forwarded from the transfer cylinder 34, and the sheet P is attracted to and carried on the drum 31 by the suction airflows by the suction device. As the drum 31 rotates, the sheet P is conveyed.

The liquid discharge device 32 includes discharge units 33 (33A to 33F) to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). In addition, a discharge unit to discharge a special liquid, that is, a liquid of spot color such as white, gold, or silver, can be used.

The discharge operation of the discharge unit 33 of the liquid discharge device 32 is controlled by a drive signal corresponding to print data. When the sheet P carried on the drum 31 passes through a region facing the liquid discharge device 32, the respective color liquids are discharged from the discharge units 33, and an image corresponding to the print data is formed.

The drying unit 40 dries the liquid applied onto the sheet P in the printing unit 30. As a result, a liquid component such as moisture in the liquid evaporates, and the colorant contained in the liquid is fixed on the sheet P. Additionally, curling of the sheet P is inhibited.

The reversing unit 60 reverses, in switchback manner, the sheet P that has passed through the drying unit 40 in double-sided printing. The reverted sheet P is fed back to the upstream side of the transfer cylinder 34 through a conveyance passage 61 of the printing unit 30.

The unloading unit 50 includes an unloading tray 51 on which a plurality of sheets P is stacked. The plurality of sheets P conveyed through the reversing unit 60 is sequentially stacked and held on the unloading tray 51.

Figure 2:
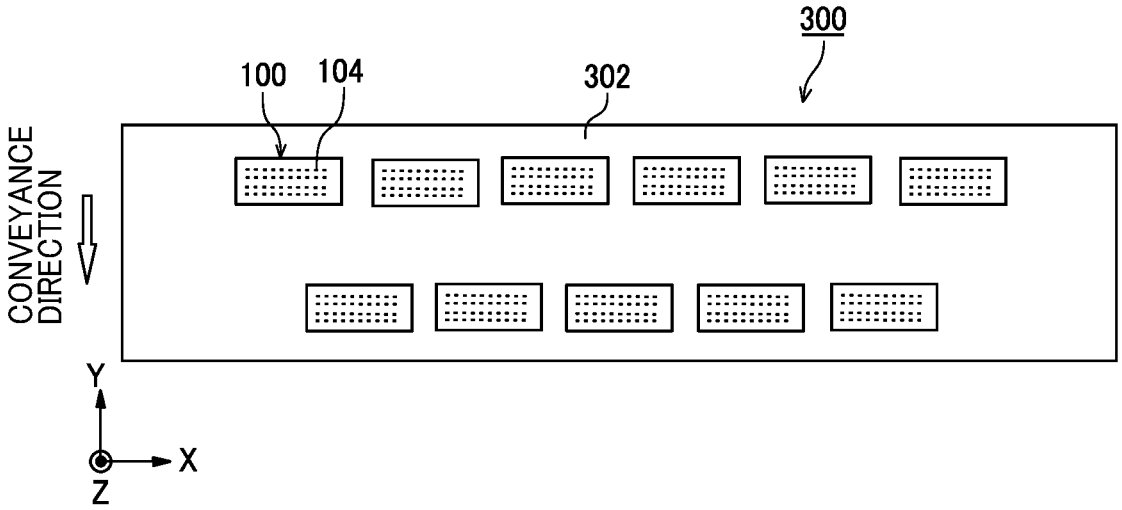
FIG. 2 is a plan view of a head unit as a discharge unit of the liquid discharge apparatus as viewed from a nozzle face side.

Next, an example of a head unit serving as the discharge unit is described with reference to FIG. 2. FIG. 2 is a plan view of the head unit as viewed from a surface of a nozzle plate (i.e., a nozzle face).

A head unit 300 includes a plurality of heads 100 to discharge liquid. The heads 100 are arranged in a staggered manner on a head mount 302.

Each head 100 has a plurality of nozzle rows in each of which a plurality of nozzles 104 to discharge liquid is lined (in this example, four rows, but the number of rows is not limited thereto).

Figure 3:
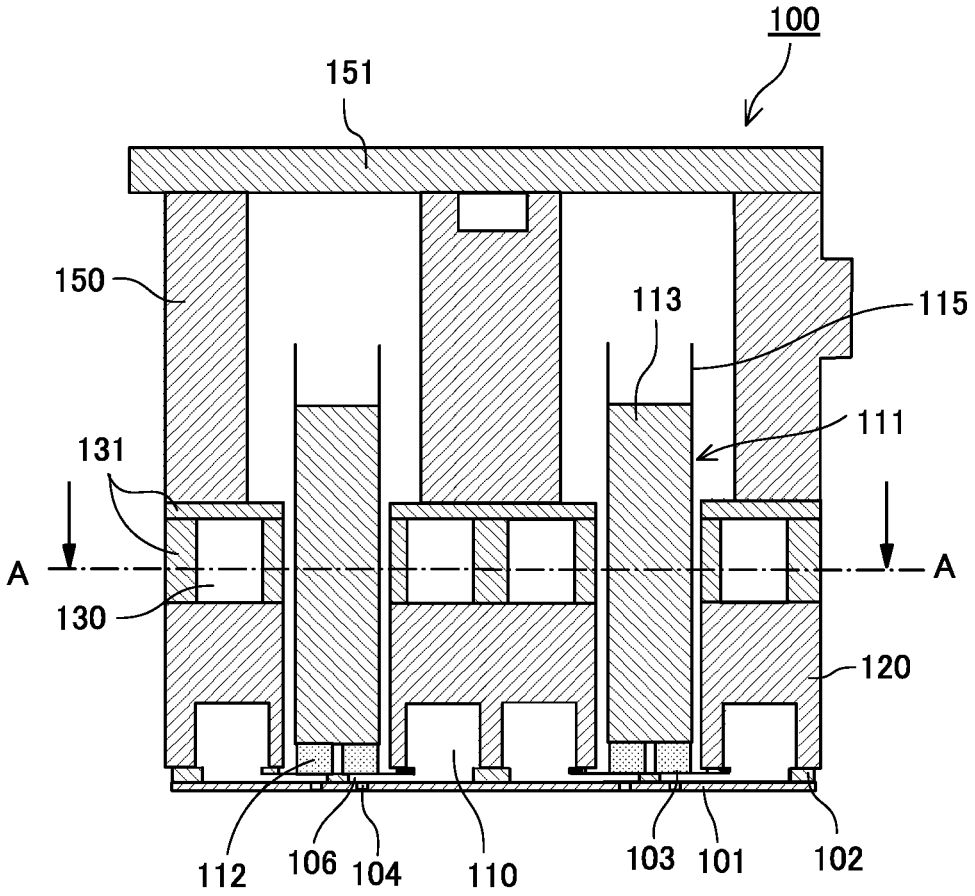
FIG. 3 is a cross-sectional view of a head of the head unit illustrated in FIG. 2 along a short-side direction (perpendicular to a nozzle array direction in which nozzles rows extend)
Figure 4:
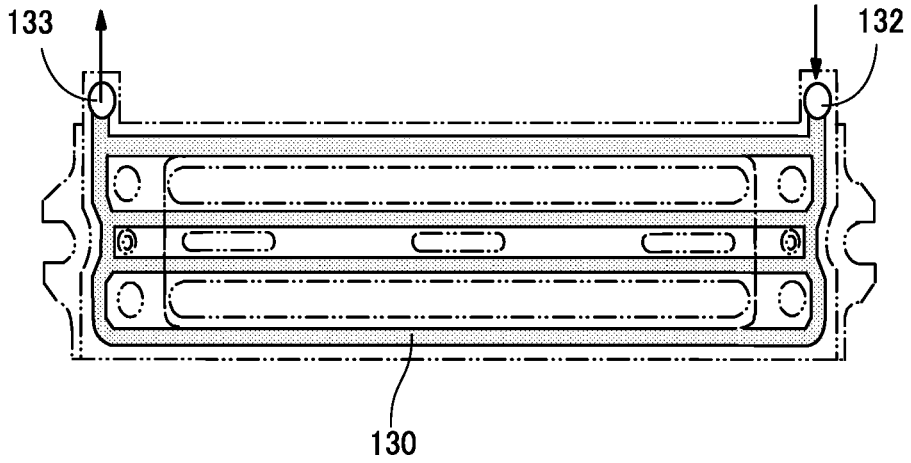
FIG. 4 is a plan view of a temperature-controlled liquid channel taken along the line A-A in FIG. 3.

Next, an example of the head 100 is described with reference to FIGS. 3 and 4. FIG. 3 is a cross-sectional view of the head 100 along a short-side direction of the head 100 (perpendicular to the nozzle array direction in which nozzles rows extend). FIG. 4 is a plan view of a temperature-controlled liquid channel 130 taken along the line A-A in FIG. 3.

The head 100 includes a nozzle plate 101 in which the nozzles 104 are formed, a channel substrate 102 that defines channels such as pressure chambers 106 communicating with the nozzles 104, and diaphragms 103 forming walls of the pressure chambers 106, which are sequentially stacked. The head 100 further includes piezoelectric actuators 111 and a frame 120 as a common channel member.

The piezoelectric actuator 111 includes a plurality of columnar piezoelectric elements 112 on a base 113. The piezoelectric element 112 is joined to the diaphragm 103. Wiring 115 is connected to the piezoelectric elements 112.

The frame 120, which also serves as the common channel member, forms a common supply channel 110 to supply the liquid (ink) to be discharged, to the pressure chamber 106.

To the frame 120, a temperature-controlled liquid channel member 131 is joined. The temperature-controlled liquid channel member 131 defines the temperature-controlled liquid channel 130 in the head 100 for flowing a temperature-controlled liquid. The temperature-controlled liquid channel member 131 includes a temperature-controlled liquid supply port 132 to supply the temperature-controlled liquid to the temperature-controlled liquid channel 130, and a temperature-controlled liquid collection port 133 from which the temperature-controlled liquid is discharged outside for collection.

The frame 120 and the temperature-controlled liquid channel member 131 are thermally coupled. Accordingly, in the head 100, the common supply channel 110, which is a flow channel for ink, and the temperature-controlled liquid channel 130 are thermally coupled.

On the temperature-controlled liquid channel member 131, a case 150 and a lid 151 are stacked in this order.

Figure 5:
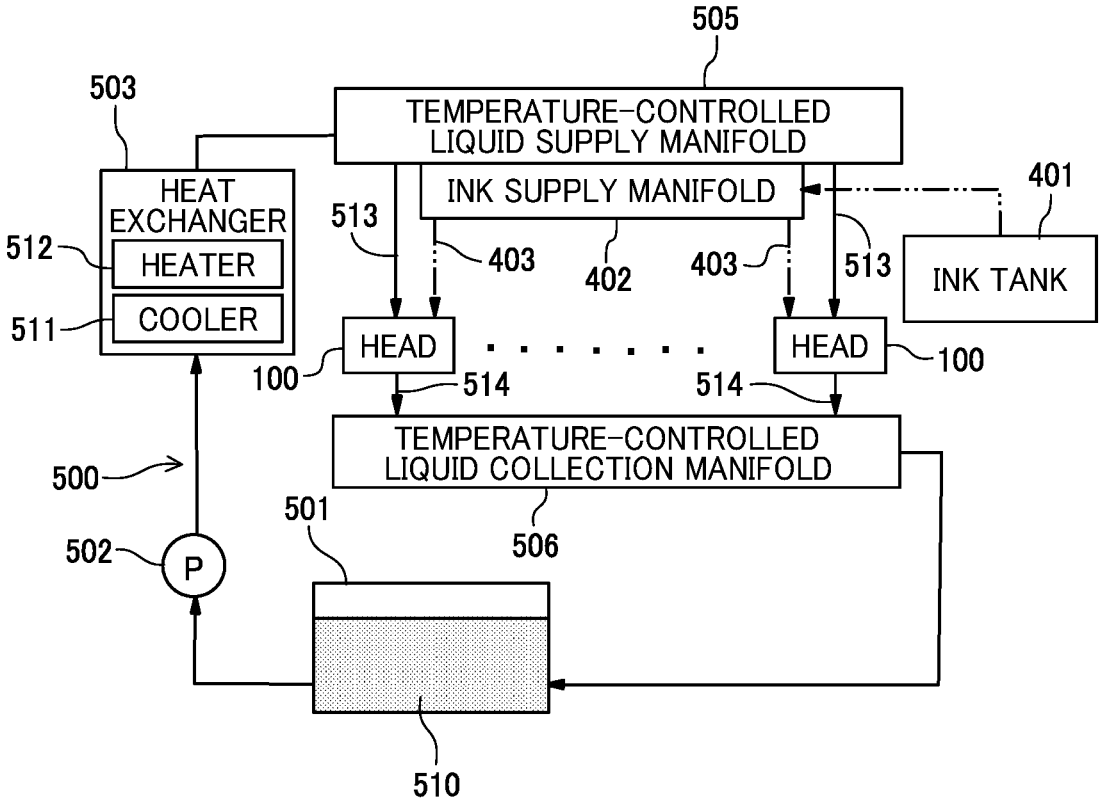
FIG. 5 is a block diagram illustrating a liquid supply system and a temperature-controlled liquid circulation system according to the first embodiment.

Next, a description is given below of a liquid (ink) supply system and a temperature-controlled liquid circulation system according to the first embodiment, with reference to the block diagram in FIG. 5.

The ink supply system includes an ink tank 401 (a liquid tank) that stores ink (liquid) to be supplied to the head 100, and an ink supply manifold 402. The ink supply manifold 402 (a liquid supply manifold) distributes and supplies the ink (the liquid) supplied from the ink tank 401 to the plurality of heads 100. The ink supply manifold 402 and the heads 100 are coupled by an ink supply passage 403 such as a tube.

The temperature-controlled liquid circulation system includes a temperature-controlled liquid tank 501 to store a temperature-controlled liquid 510, a liquid feed pump 502 to feed the temperature-controlled liquid 510, a heat exchanger 503 to exchange heat with the temperature-controlled liquid 510, a temperature-controlled liquid supply manifold 505 to distribute and supply the temperature-controlled liquid 510 to each head 100, and a temperature-controlled liquid collection manifold 506 to collect the temperature-controlled liquid 510 from the heads 100.

The heat exchanger 503 includes a cooler 511 that cools the temperature-controlled liquid 510, and a heater 512 that heats the temperature-controlled liquid 510.

The temperature-controlled liquid supply manifold 505 is coupled to the temperature-controlled liquid supply port 132 of each head 100 by a supply passage 513 such as a tube. The temperature-controlled liquid collection manifold 506 is coupled to the temperature-controlled liquid collection port 133 of each head 100 by a collection passage 514 such as a tube.

As the liquid feed pump 502 is driven, the temperature-controlled liquid 510 stored in the temperature-controlled liquid tank 501 circulates through a circulation passage 500 that passes the liquid feed pump 502, the heat exchanger 503, the temperature-controlled liquid supply manifold 505, the head 100, and the temperature-controlled liquid collection manifold 506, and then returns to the temperature-controlled liquid tank 501.

Thus, in the flow direction of the temperature-controlled liquid 510 in the circulation passage 500, the cooler 511 (e.g., a radiator) of the heat exchanger 503, the heater 512 (a heating device), the temperature-controlled liquid supply manifold 505, and the head 100 are disposed in this order.

With this configuration, when the printer 1 is started up in a low temperature state, the temperature-controlled liquid 510 heated by the heater 512 is supplied to the head 100 before being cooled by the cooler 511. Therefore, the ink temperature can be quickly adjusted with the temperature-controlled liquid 510, and the startup time can be shortened.

The ink supply manifold 402 and the temperature-controlled liquid supply manifold 505 are thermally coupled.

Figure 6:
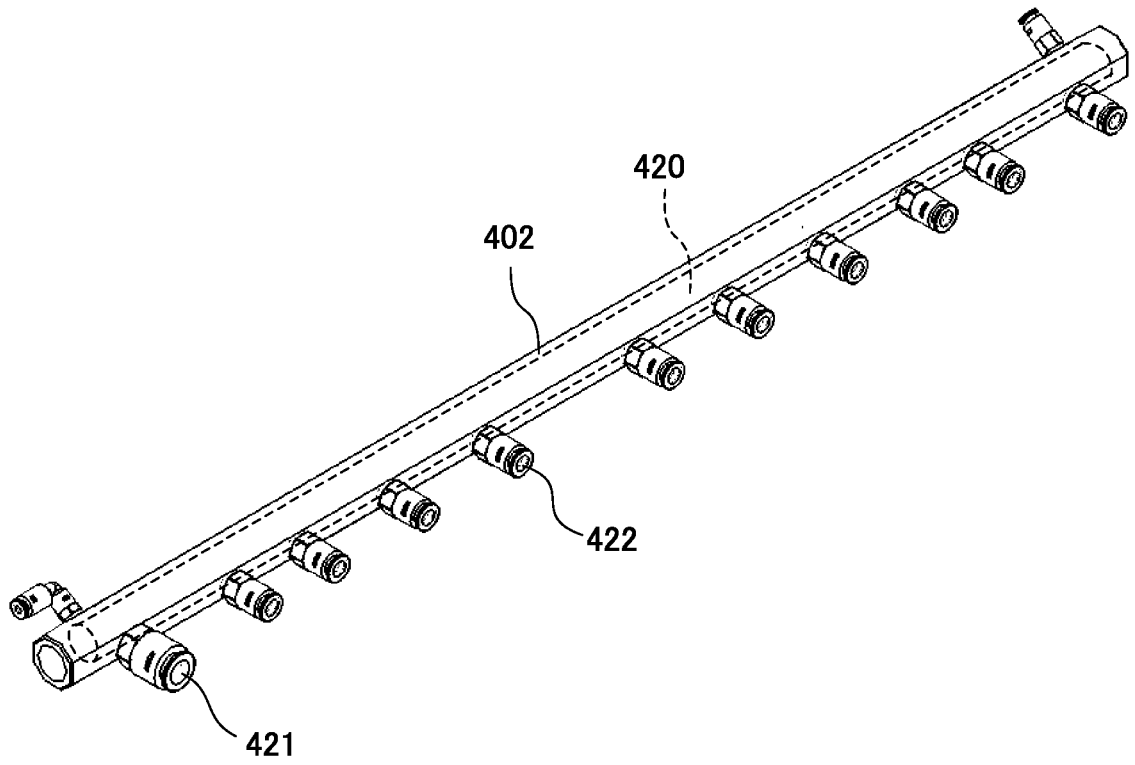
FIG. 6 is an exterior perspective view of an example of an ink supply manifold according to the first embodiment.
Figure 7:
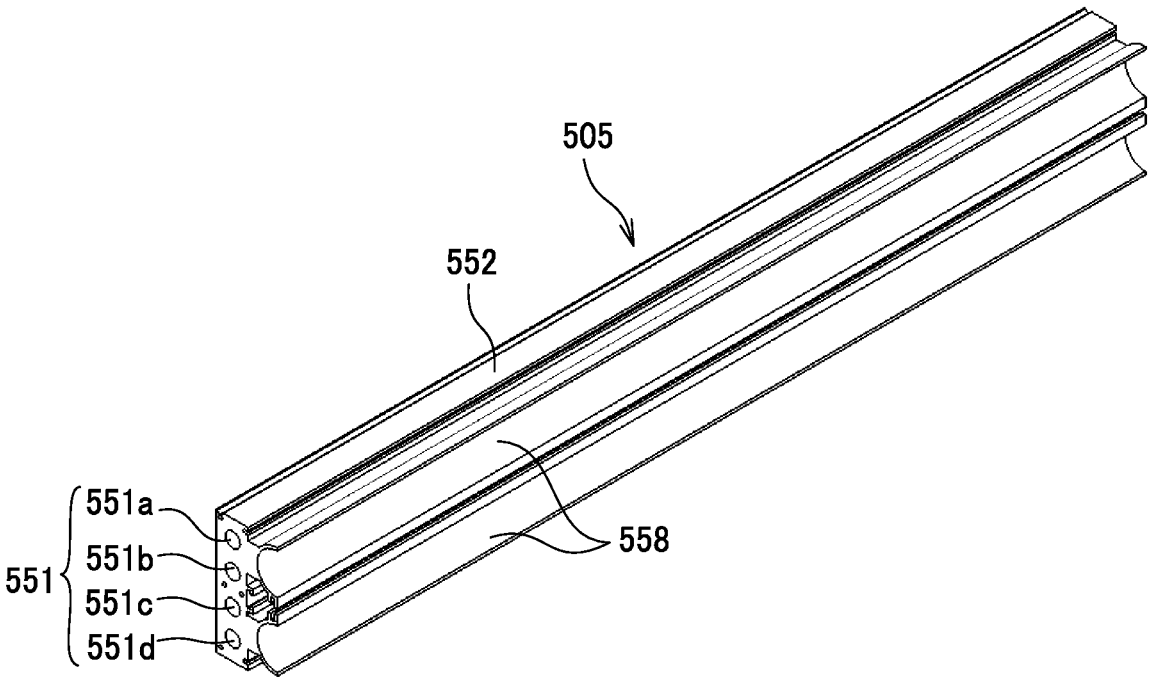
FIG. 7 is an exterior perspective view of a temperature-controlled liquid supply manifold according to the first embodiment.
Figure 8:
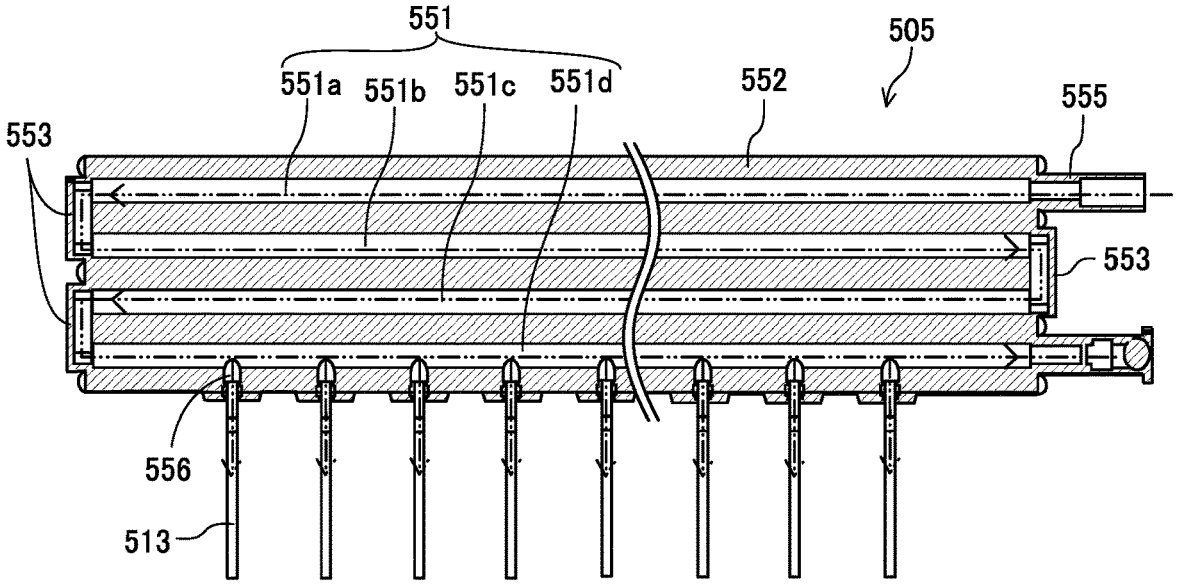
FIG. 8 is a cross-sectional view illustrating the temperature-controlled liquid supply manifold illustrated in FIG. 7.
Figure 9:
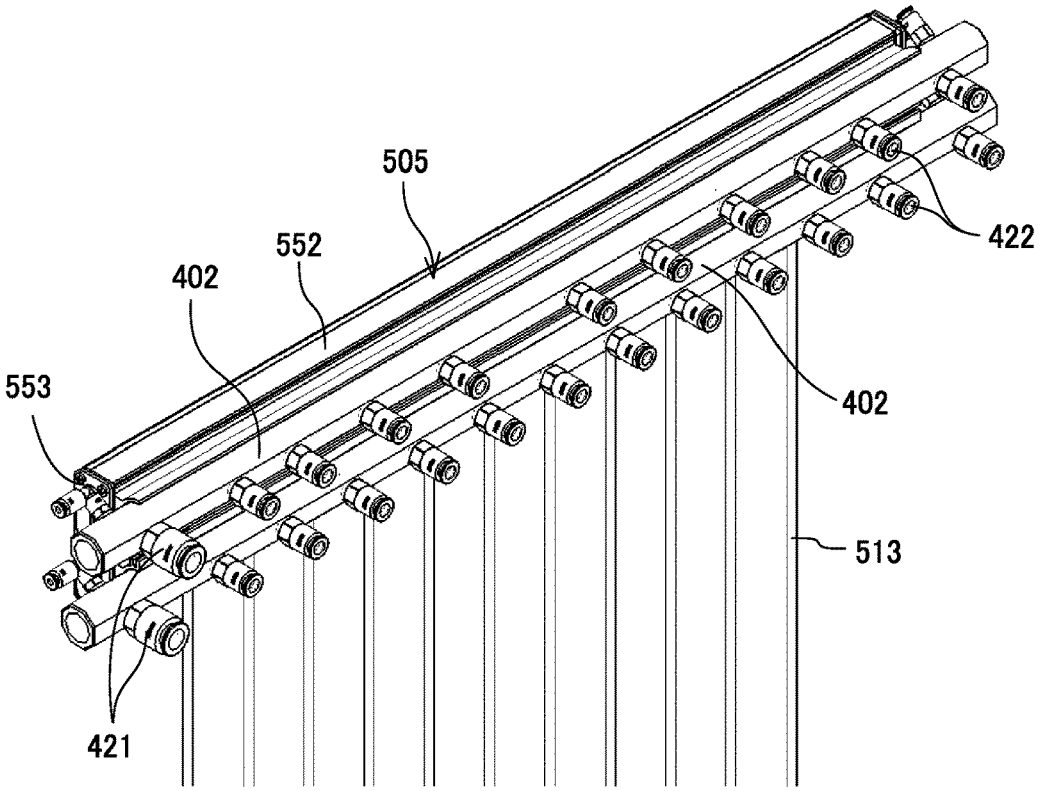
FIG. 9 is a perspective view illustrating the ink supply manifold and the temperature-controlled liquid supply manifold in an assembled state.

Next, a description is given of the ink supply manifold, the temperature-controlled liquid supply manifold, and the thermal coupling therebetween, with reference to FIGS. 6 to 8. FIG. 6 is an exterior perspective view of an example of the ink supply manifold. FIG. 7 is an exterior perspective view of an example of the temperature-controlled liquid supply manifold. FIG. 8 is a cross-sectional view illustrating the temperature-controlled liquid supply manifold illustrated in FIG. 7. FIG. 9 is a perspective view illustrating the ink supply manifold and the temperature-controlled liquid supply manifold assembled.

The ink supply manifold 402 is a tubular member in which an ink supply channel 420 that is a first liquid channel is formed. The ink supply manifold 402 includes an inlet port 421 to which ink is supplied from the ink tank 401 and outlet ports 422 from which the ink is supplied to the heads 100, respectively.

The temperature-controlled liquid supply manifold 505 is a plate member in which a temperature-controlled liquid channel 551 is formed. The temperature-controlled liquid supply manifold 505 includes an inlet port 555 to which temperature-controlled liquid is supplied from the heat exchanger 503 and outlet ports 556 from which the temperature-controlled liquid is supplied to the heads 100, respectively.

The temperature-controlled liquid supply manifold 505 includes a manifold body 552 in which a plurality of liquid channels 551*a* to 551*d* extends along the longitudinal direction thereof. Further, folding-back caps 553 are attached to both ends of the manifold body 552.

With this structure, the plurality of liquid channels 551*a* to 551*d* is connected and folded back in the channels of the folding-back caps 553, thereby forming the temperature-controlled liquid channel 551. Since the temperature-controlled liquid channel 551 includes the liquid channels 551*a* to 551*d* that are folded back, the temperature gradient of the temperature-controlled liquid inside the temperature-controlled liquid supply manifold 505 can be reduced.

The liquid channel 551*d* is provided with the outlet ports 556 to supply the temperature-controlled liquid 510 to the heads 100, respectively. The temperature-controlled liquid 510 is supplied from the outlet port 556 to the temperature-controlled liquid supply port 132 of the head 100 via the supply passage 513.

A side face of the manifold body 552 of the temperature-controlled liquid supply manifold 505 includes fitting portions 558 (FIG. 7) to which the ink supply manifold 402 is fitted. In the example illustrated in FIGS. 7 and 9, two fitting portions 558 are provided along the longitudinal direction of the manifold body 552, and two ink supply manifolds 402 are fitted thereto.

As illustrated in FIG. 9, the ink supply manifold 402 is fitted to the fitting portions 558 (FIG. 7) of the manifold body 552 of the temperature-controlled liquid supply manifold 505. Thus, the temperature-controlled liquid supply manifold 505 and the ink supply manifold 402 are thermally coupled. As a result, an ink supply channel 420 of the ink supply manifold 402 and the temperature-controlled liquid channel 551 of the temperature-controlled liquid supply manifold 505 are thermally coupled.

From the upper ink supply manifold 402, the ink is supplied through the outlet ports 422 to the heads 100 on the upstream side in the conveyance direction illustrated in FIG. 2. From the lower ink supply manifold 402, ink is supplied through the outlet ports 422 to the heads 100 on the downstream side in the conveyance direction illustrated in FIG. 2.

With the thermal coupling between the temperature-controlled liquid supply manifold 505 and the ink supply manifold 402, the ink temperature can be adjusted before the ink is supplied to the plurality of heads 100, thereby reducing temperature changes (temperature gradient) of the ink supplied to the heads 100. This reduces variations in the ink discharge properties of the heads 100.

Figure 10:
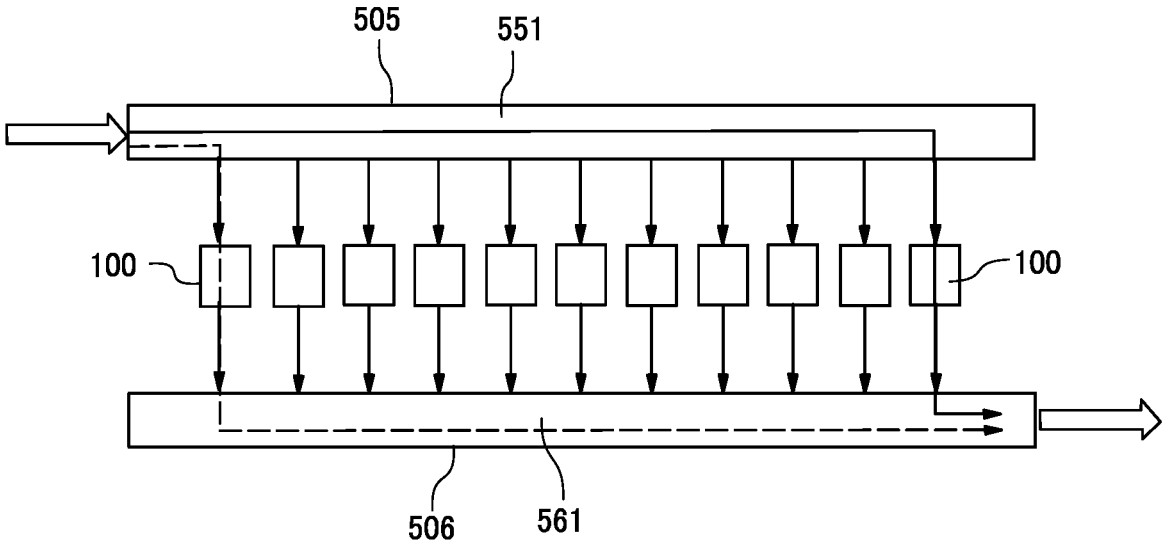
FIG. 10 is a view illustrating the temperature-controlled liquid supply manifold and a connection between the temperature-controlled liquid collection manifold with heads, according to the first embodiment.

Next, a description is given of the connections of the temperature-controlled liquid supply manifold and the temperature-controlled liquid collection manifold with the heads, with reference to FIG. 10. FIG. 10 is a schematic cross-sectional side view thereof.

The extreme upstream outlet port 556 (FIG. 8) of the temperature-controlled liquid channel 551 of the temperature-controlled liquid supply manifold 505 is coupled, via the head 100, to the extreme upstream inlet of a liquid channel 561 of the temperature-controlled liquid collection manifold 506. Similarly, the second outlet port 556 from the upstream side of the temperature-controlled liquid channel 551 is coupled, via the head 100, to the second inlet, from the upstream side of the liquid channel 561, of the temperature-controlled liquid collection manifold 506. The subsequent connections are similar thereto. Then, the extreme downstream outlet port 556 of the temperature-controlled liquid channel 551 is coupled, via the head 100, to the extreme downstream inlet of the liquid channel 561 of the temperature-controlled liquid collection manifold 506.

In other words, the supply passage 513 and the collection passage 514 construct a temperature-controlled liquid passage in which the head 100 is connected to the temperature-controlled liquid supply manifold 505 and the temperature-controlled liquid collection manifold 506, and the distance from the outlet port 556 of the temperature-controlled liquid supply manifold 505 via the head 100 to the inlet port 565 of the temperature-controlled liquid collection manifold 506 is equal among the plurality of heads 100.

Such connection relationships can equalize the configurations of the liquid channels of the temperature-controlled liquid that pass through all the heads 100, thereby equalizing the pressure loss in the liquid channels of the temperature-controlled liquid passing through the heads 100. Accordingly, the flow rates and flow speeds are equalized, and the temperature can be equally adjusted in all the heads 100.

In this case, the temperature-controlled liquid collection manifold 506 is preferably made of the same material and the same in length as the temperature-controlled liquid supply manifold 505. For example, an extruded aluminum alloy such as A6063 can be used to produce the temperature-controlled liquid supply manifold 505 and the temperature-controlled liquid collection manifold 506 by extrusion molding. Then, the manufacturing cost can be low.

Figure 11:
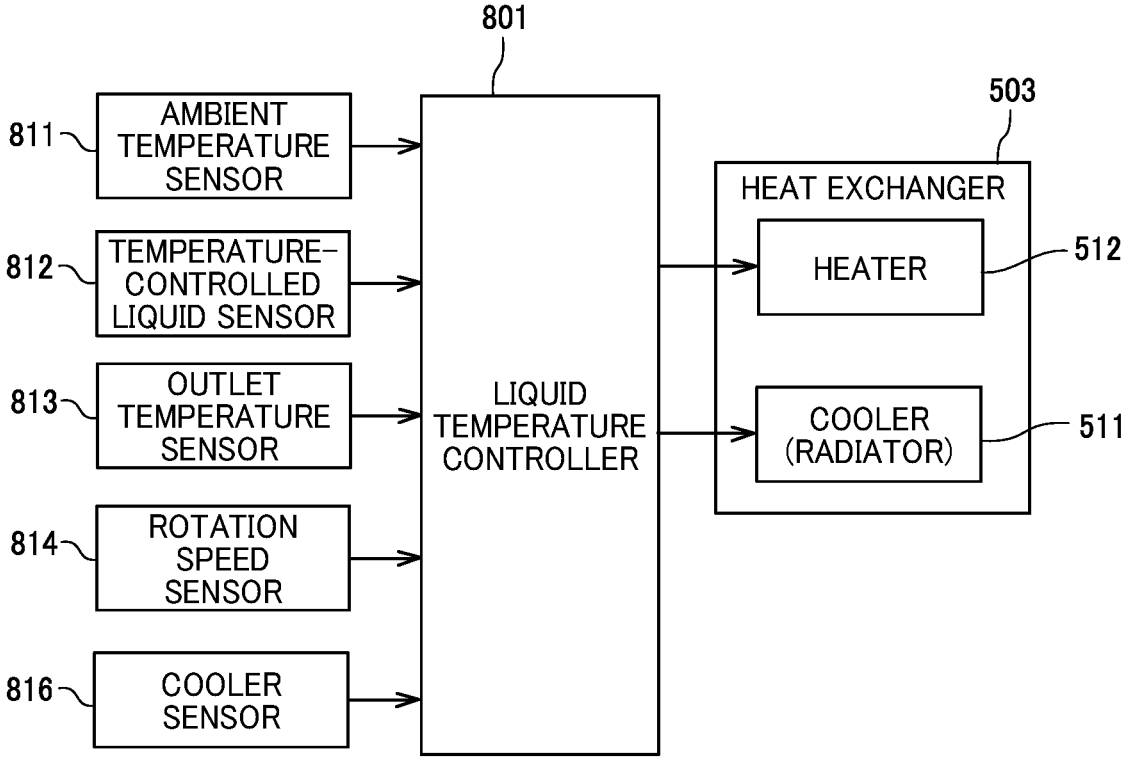
FIG. 11 is a block diagram illustrating a configuration of temperature control of the temperature-controlled liquid according to the first embodiment.

Next, a description is given of the temperature control of the temperature-controlled liquid, with reference to the block diagram in FIG. 11.

A temperature-controlled liquid temperature controller 801 receives detection results from an ambient temperature sensor 811 to detect ambient temperature, a temperature-controlled liquid sensor 812 to detect the temperature (inflow temperature) of the temperature-controlled liquid 510 at the inlet of the cooler 511, an outlet temperature sensor 813 to detect the temperature (outflow temperature) of the temperature-controlled liquid 510 at the outlet of the heat exchanger 503.

The temperature-controlled liquid temperature controller 801 further receives detection results from a rotation speed sensor 814 that detects the rotation speed of a fan of the radiator serving as the cooler 511, and a cooler sensor 816 that detects the temperature of the temperature-controlled liquid 510 at the outlet of the cooler 511.

Then, the temperature-controlled liquid temperature controller 801 controls the cooler 511 and the heater 512 of the heat exchanger 503 based on such detection results input thereto.

For example, when a temperature Ta of the temperature-controlled liquid 510 detected with the sensor is lower than a threshold temperature Te, the temperature-controlled liquid temperature controller 801 turns the heater 512 on to heat the temperature-controlled liquid 510. When the temperature Ta of the temperature-controlled liquid 510 is equal to or higher than the threshold temperature Te, the temperature-controlled liquid temperature controller 801 turns the cooler 511 on.

Further, in a case of temperature raising from a low temperature of, e.g., 10° C., in order to raise the temperatures of ink and the head 100 to a proper discharge temperature in a short time, the temperature-controlled liquid temperature controller 801 operates as follows. Set the control temperature of the heater 512 of the heat exchanger 503 to a range of from 40° C. to 50° C., drive the liquid feed pump 502 until the temperature of the temperature-controlled liquid 510 at the outlet of the heat exchanger 503 reaches 25° C., and raise the temperatures of the ink supply manifold 402, the temperature-controlled liquid supply manifold 505, the heads 100, and the supply passage 513 of the circulation passage 500.

At this time, the circulation amount per unit time of the temperature-controlled liquid 510 is made greater than the liquid supply amount (ink supply amount) per unit time corresponding to a maximum discharge amount by the plurality of heads 100. Alternatively, the flow speed of the temperature-controlled liquid 510 is set higher than the flow speed in discharging of the ink at the maximum discharge amount from the plurality of heads 100.

As a result, when the printer 1 is started up in a low temperature state, the ink temperature can be quickly adjusted by the temperature-controlled liquid 510.

Further, during continuous printing, the heat generated by the drivers of the heads 100 increases. Therefore, when the temperature exceeds the threshold, the heater 512 of the heat exchanger 503 is turned off and the cooler 511 is turned on, and the supply amount of the temperature-controlled liquid 510 is set to about five times or greater of the ink consumption amount (maximum discharge amount), to cool the heads 100 and the ink.

Further, in single-pass printing, the temperature differences among the heads 100 arranged in the sheet width direction are reduced to minimize variations in the ink discharge properties of the heads 100, thereby suppressing the density fluctuations in the heads 100.

Figure 12:
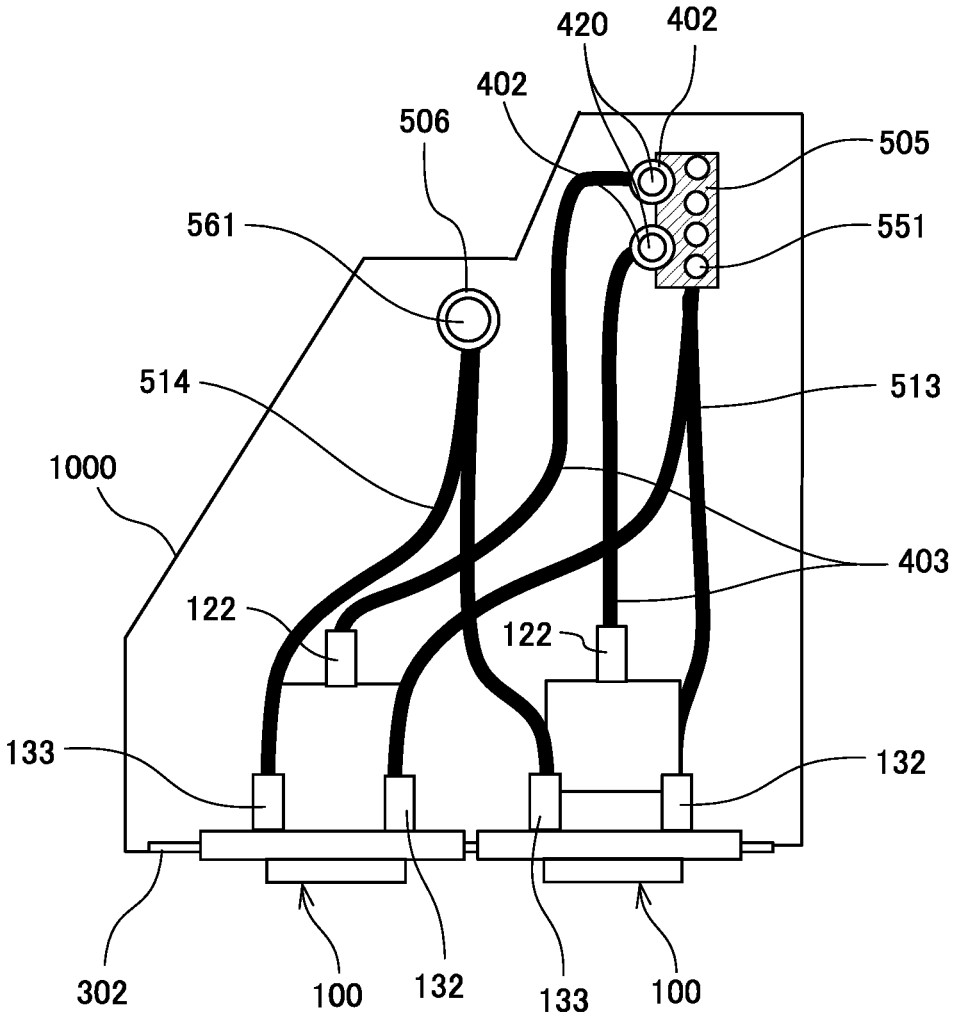
FIG. 12 is a cross-sectional view illustrating positional relations among the heads, the ink supply manifold, and the temperature-controlled liquid supply manifold.

Next, a description is given of the positional relationship among the heads 100, the temperature-controlled liquid supply manifold 505, and the temperature-controlled liquid collection manifold 506, with reference to FIG. 12.

The temperature-controlled liquid collection manifold 506 and the temperature-controlled liquid supply manifold 505 are disposed above the heads 100. Therefore, in the present embodiment, the ink supply manifolds 402 that are thermally coupled to the temperature-controlled liquid supply manifold 505 are also above the heads 100.

The ink supply manifold 402 is coupled to an ink supply port 122 of the head 100 via the ink supply passage 403. The temperature-controlled liquid supply manifold 505 is coupled to the temperature-controlled liquid supply port 132 of the head 100 via the supply passage 513. The temperature-controlled liquid collection manifold 506 is coupled to the temperature-controlled liquid collection port 133 of the head 100 via the collection passage 514.

With this configuration, high image quality can be obtained without reducing the nozzle density (head arrangement density) of the heads 100. Further, the distance between the ink supply passage 403 and the supply passage 513 of the temperature-controlled liquid can be made short, and the temperature changes in each supply passage can be restricted.

The head unit 300, the temperature-controlled liquid collection manifold 506, and the temperature-controlled liquid supply manifold 505 are combined by a cover 1000. Therefore, maintainability is improved.

Figure 13:
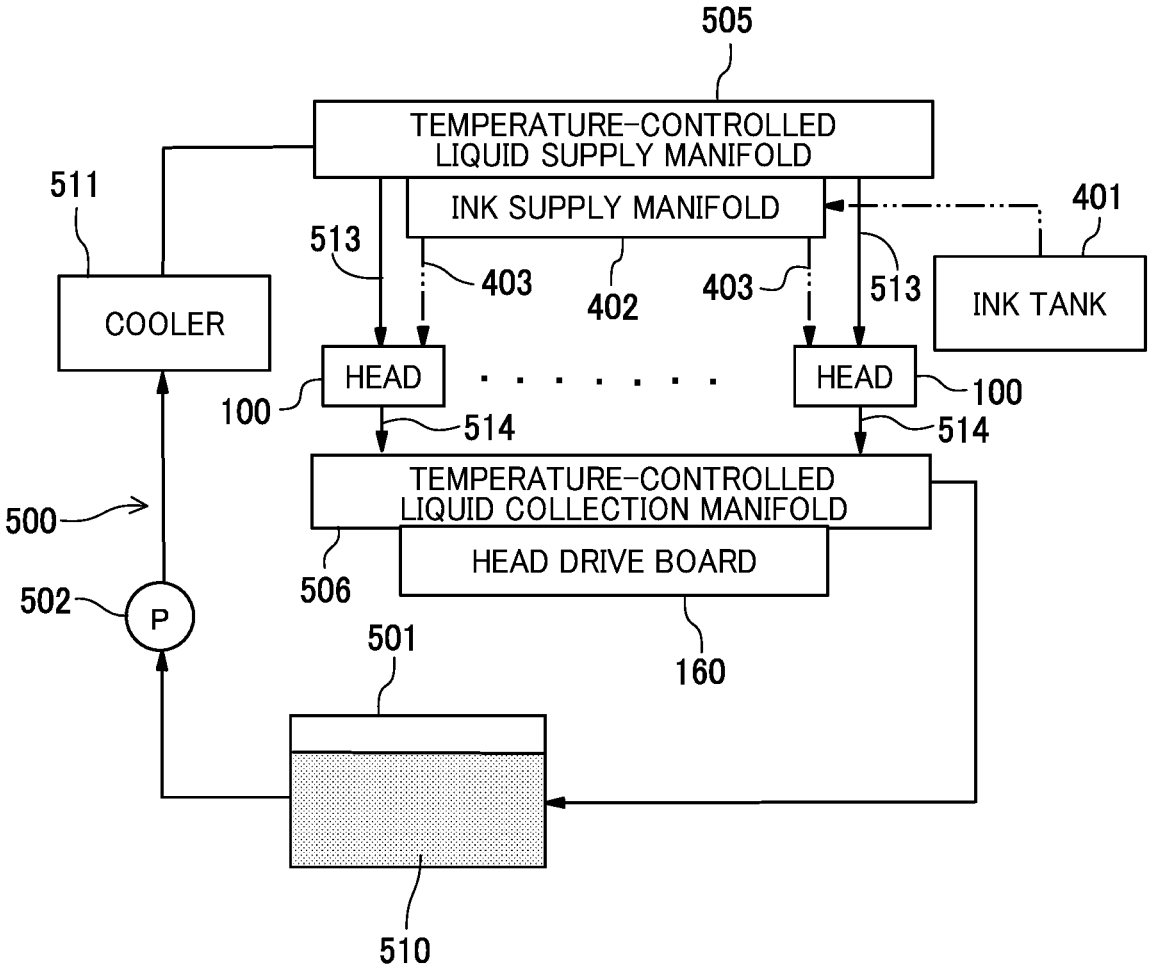
FIG. 13 is a block diagram illustrating a liquid supply system and a temperature-controlled liquid circulation system according to a second embodiment of the present disclosure.

Next, a description is given below of a liquid (ink) supply system and a temperature-controlled liquid circulation system according to a second embodiment, with reference to the block diagram in FIG. 13.

In the present embodiment, the cooler 511 is disposed between the liquid feed pump 502 and the temperature-controlled liquid supply manifold 505 instead of the heat exchanger 503 in the first embodiment. Additionally, a head drive board 160 (a driver IC mounting substrate) is thermally coupled to the temperature-controlled liquid collection manifold 506.

The temperature-controlled liquid circulation system includes the temperature-controlled liquid tank 501 to store the temperature-controlled liquid 510, the liquid feed pump 502 to feed the temperature-controlled liquid 510, the cooler 511 to cool the temperature-controlled liquid 510, the temperature-controlled liquid supply manifold 505 to distribute and supply the temperature-controlled liquid 510 to the heads 100, and the temperature-controlled liquid collection manifold 506 to collect the temperature-controlled liquid 510 from the heads 100. The cooler 511 is, for example, a radiator.

As the liquid feed pump 502 is driven, the temperature-controlled liquid 510 stored in the temperature-controlled liquid tank 501 circulates through the circulation passage 500 that passes through the liquid feed pump 502, the cooler 511, the temperature-controlled liquid supply manifold 505, each head 100, and the temperature-controlled liquid collection manifold 506. Then, the temperature-controlled liquid 510 returns to the temperature-controlled liquid tank 501.

On the head drive board 160, a drive waveform generation unit that generates drive waveforms to be applied to the piezoelectric actuators 111 of the plurality of heads 100 and a power amplification unit 161 (FIG. 17) that amplifies the drive waveforms are mounted. A heat generation portion of the head drive board 160 is thermally coupled onto the temperature-controlled liquid collection manifold 506.

In the system configured as described above, the liquid feed pump 502 pumps up the temperature-controlled liquid 510 from the temperature-controlled liquid tank 501. Then, the temperature-controlled liquid 510 passes through the cooler 511 that cools the temperature-controlled liquid 510, and is distributed from the temperature-controlled liquid supply manifold 505 to the heads 100.

As the temperature-controlled liquid 510 passes through the temperature-controlled liquid channel 130 of each head 100, the temperature-controlled liquid 510 cools the frame 120 (a housing) of the head 100. After passing through the head 100, the temperature-controlled liquid 510 is collected in the temperature-controlled liquid collection manifold 506, cools the head drive board 160 (a drive circuit) to cool the power amplification unit 161 (FIG. 17) and the like, and returns to the temperature-controlled liquid tank 501.

Meanwhile, the ink is supplied from the ink tank 401 to the ink supply manifold 402 and distributed to each head 100.

Figure 14:
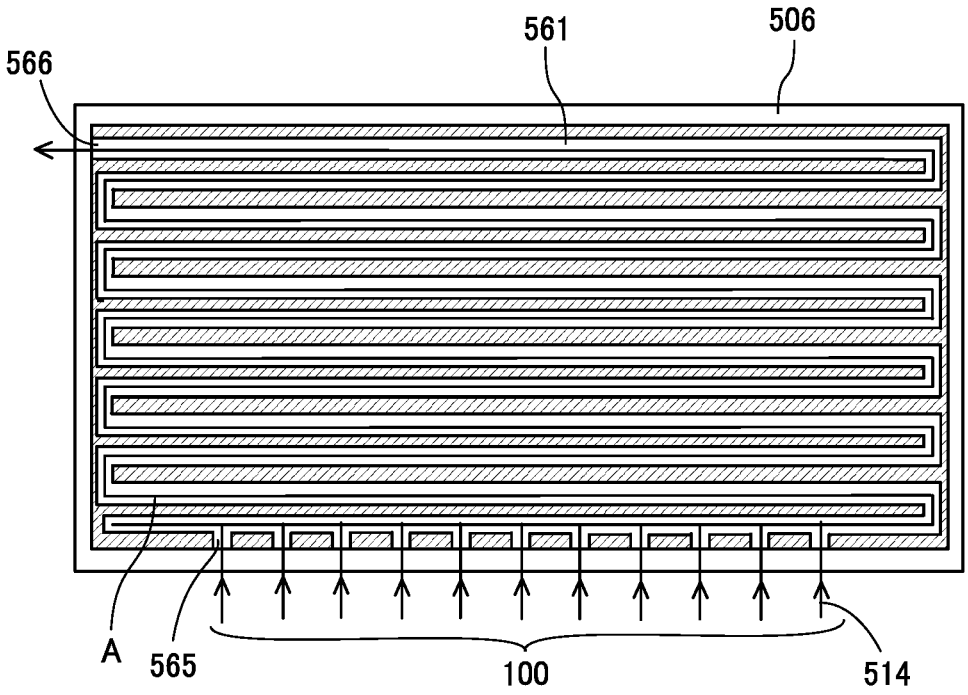
FIG. 14 is a front cross-sectional view illustrating a temperature-controlled liquid channel of the temperature-controlled liquid collection manifold according to the second embodiment.
Figure 15:
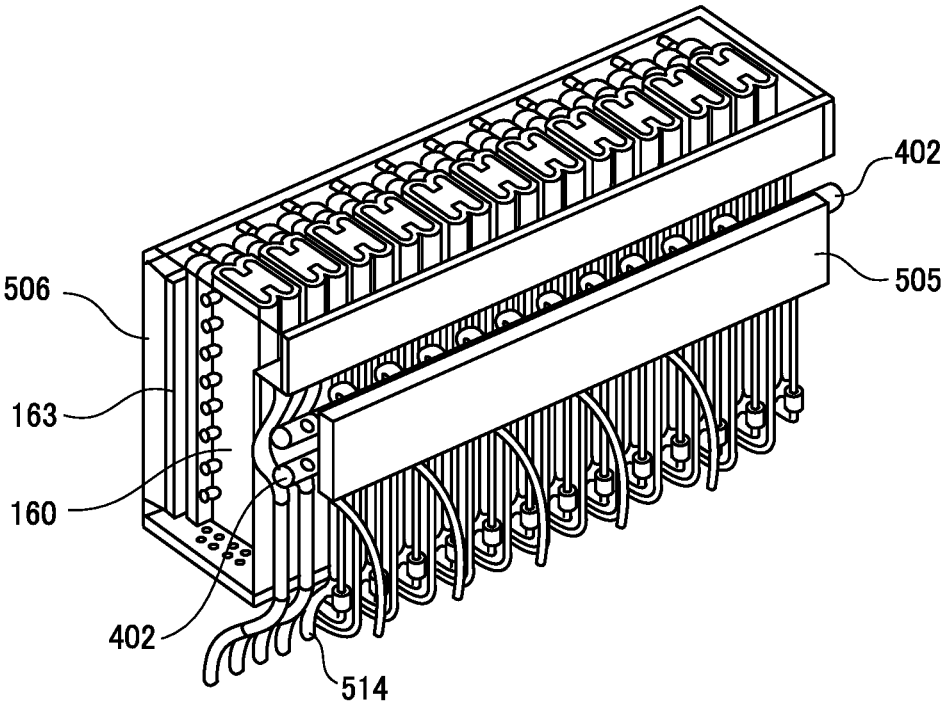
FIG. 15 is a perspective view illustrating a connection between the temperature-controlled liquid collection manifold and a head drive board according to the second embodiment.
Figure 16:
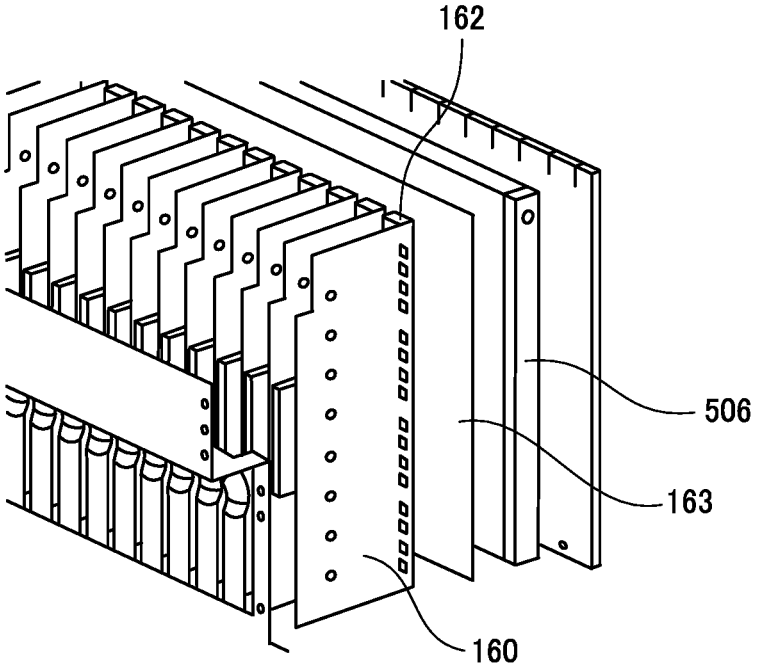
FIG. 16 is an exploded perspective view illustrating the connection between the temperature-controlled liquid collection manifold and the head drive board according to the second embodiment.

Next, a description is given of the temperature-controlled liquid collection manifold 506 and the thermal coupling of the temperature-controlled liquid collection manifold 506 with the head drive board 160, with reference to FIGS. 14 to 16. FIG. 14 is a front cross-sectional view referring to which the liquid channel 561 of the temperature-controlled liquid collection manifold 506 is described in detail. FIG. 15 is a perspective view of the connection between the temperature-controlled liquid collection manifold 506 and the head drive board 160. FIG. 16 is an exploded perspective view thereof.

The temperature-controlled liquid collection manifold 506 has therein the liquid channel 561 through which the temperature-controlled liquid 510 supplied from each head 100 through the collection passage 514 flows in the direction indicated by arrow A. The temperature-controlled liquid collection manifold 506 further includes inlet ports 565 coupled to the plurality of collection passages 514 and an outlet port 566 to discharge the temperature-controlled liquid 510 to the temperature-controlled liquid tank 501.

The liquid channel 561 is constructed of a plurality of channels extending along the longitudinal direction of the temperature-controlled liquid collection manifold 506 and includes turnups at both ends in the longitudinal direction, so that the plurality of channels are connected.

On the head drive board 160, the power amplification unit 161 (see FIG. 17, to be described later) that amplifies a drive waveform is mounted, and a heatsink 162 is provided in contact with the power amplification unit 161. The power amplification unit 161 is constructed of, for example, a metal-oxide semiconductor field-effect transistor (MOSFET).

In this structure, the heatsink 162 of the head drive board 160 is secured to the temperature-controlled liquid collection manifold 506 via a heat conductive sheet 163, thereby thermally coupling the temperature-controlled liquid collection manifold 506 and the power amplification unit 161 of the head drive board 160.

Figure 17:
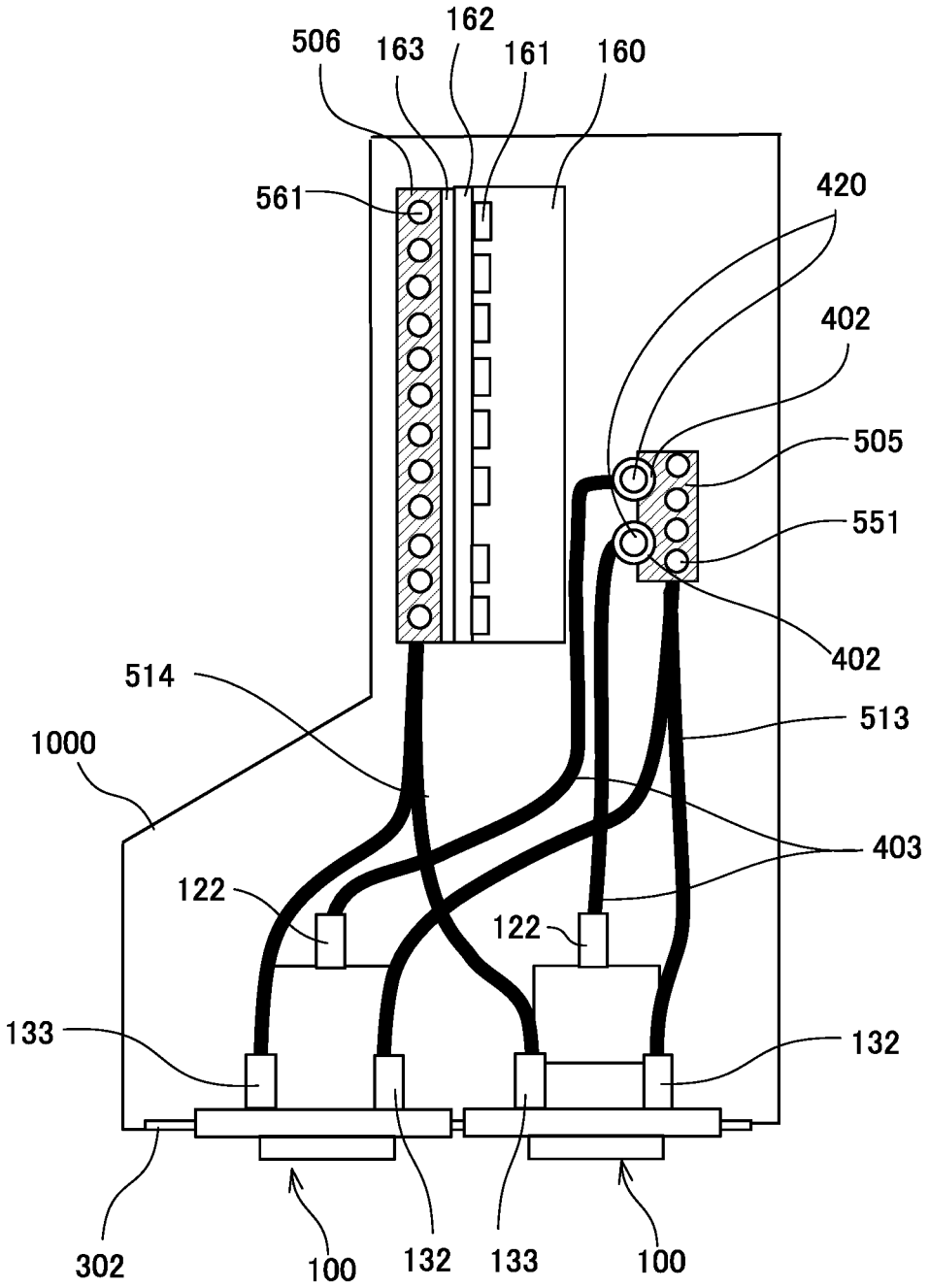
FIG. 17 is a cross-sectional view illustrating positional relations among the heads, the ink supply manifold, and the temperature-controlled liquid supply manifold according to the second embodiment.

Next, a description is given of the positional relationship between the heads 100, the temperature-controlled liquid supply manifold 505, and the temperature-controlled liquid collection manifold 506, with reference to FIG. 17. FIG. 17 is a view illustrating the positional relationship therebetween.

The temperature-controlled liquid collection manifold 506 and the temperature-controlled liquid supply manifold 505 are disposed above the heads 100.

With this configuration, high image quality can be obtained without reducing the nozzle density (head arrangement density) of the heads 100. Further, the distance between the ink supply passage 403 and the supply passage 513 of the temperature-controlled liquid can be made short, and the temperature changes in each supply passage can be restricted. Further, the head drive board 160 that is thermally coupled to the temperature-controlled liquid collection manifold 506 is disposed above the head 100. Therefore, the temperature rise of the head 100 can be inhibited.

The head unit 300 (FIG. 2), the temperature-controlled liquid collection manifold 506, and the temperature-controlled liquid supply manifold 505 are combined by a cover 1000. Thus, maintainability improves.

Figure 18:
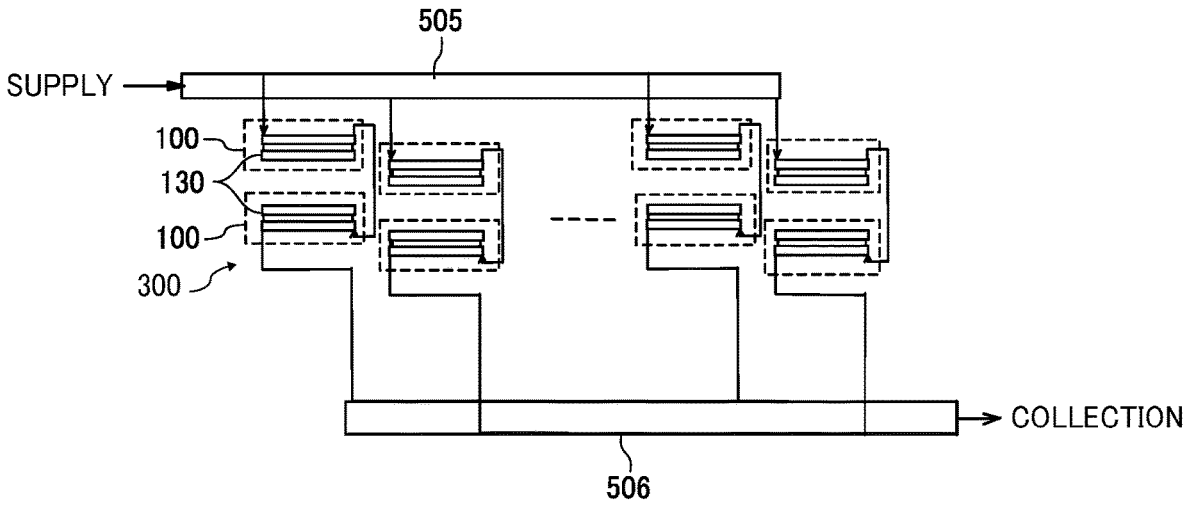
FIG. 18 is a diagram illustrating a configuration of a head unit and a temperature-controlled liquid circulation passage according to a third embodiment of the present disclosure.
Figure 19:
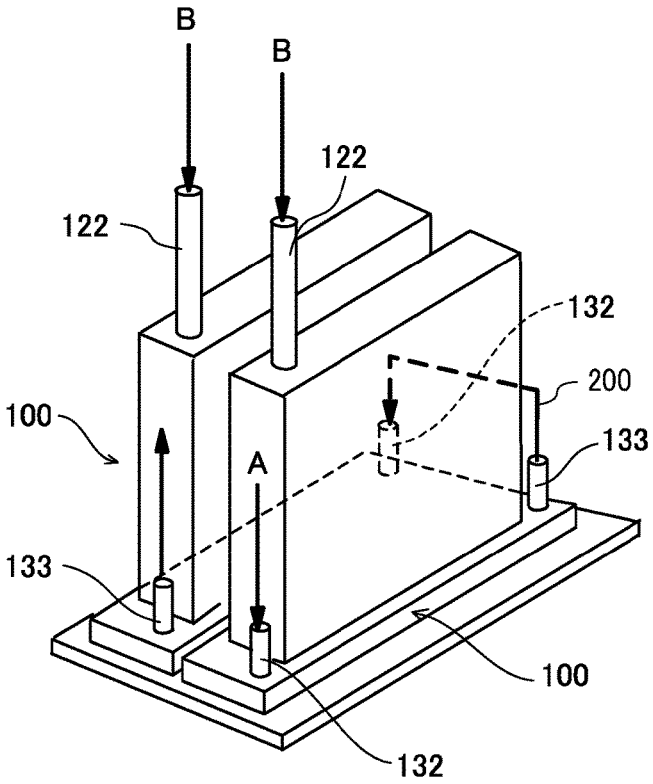
FIG. 19 is a perspective view illustrating a temperature-controlled liquid circulation passage of a dual head of the head unit illustrated in FIG. 18.

Next, a description is given of a third embodiment of the present disclosure, with reference to FIGS. 18 and 19. FIG. 18 is a view illustrating a configuration of the head unit and the circulation passage of the temperature-controlled liquid according to the third embodiment. FIG. 19 is a perspective view illustrating a temperature-controlled liquid circulation passage of a dual head.

The head unit 300 includes pairs of heads (dual heads) 100 to discharge liquid, arranged in a staggered arrangement.

As indicated by solid arrow A in FIG. 19, the temperature-controlled liquid 510 is supplied from the temperature-controlled liquid supply manifold 505 to the temperature-controlled liquid supply port 132 of the first one of the two heads 100. Then, the temperature-controlled liquid 510 passes through the frame 120 of the first head 100 and is collected from the temperature-controlled liquid collection port 133. The temperature-controlled liquid 510 collected from the first head 100 is supplied via a supply passage 200 (e.g., a tube) to the temperature-controlled liquid supply port 132 of the second head 100. Then, the temperature-controlled liquid 510 passes through the frame 120 of the second head 100 and is collected from the temperature-controlled liquid collection port 133.

The temperature-controlled liquid 510 collected from the temperature-controlled liquid collection port 133 of the second head 100 passes through a cooling member and is collected in the temperature-controlled liquid collection manifold 506.

Note that ink is supplied to each head 100 through the ink supply port 122, as indicated by arrow B in FIG. 19.

The present embodiment is advantageous in the arrangement in the conveyance direction. That is, the distance in the staggered arrangement of the same color in the conveyance direction and the distance among black (K), cyan (C), magenta (M), and yellow (Y) are shortened to reduce the apparatus size. Additionally, this arrangement can reduce image unevenness due to disturbance components such as fluctuations in speed in the conveyance direction and meandering of the sheet.

Figure 20:
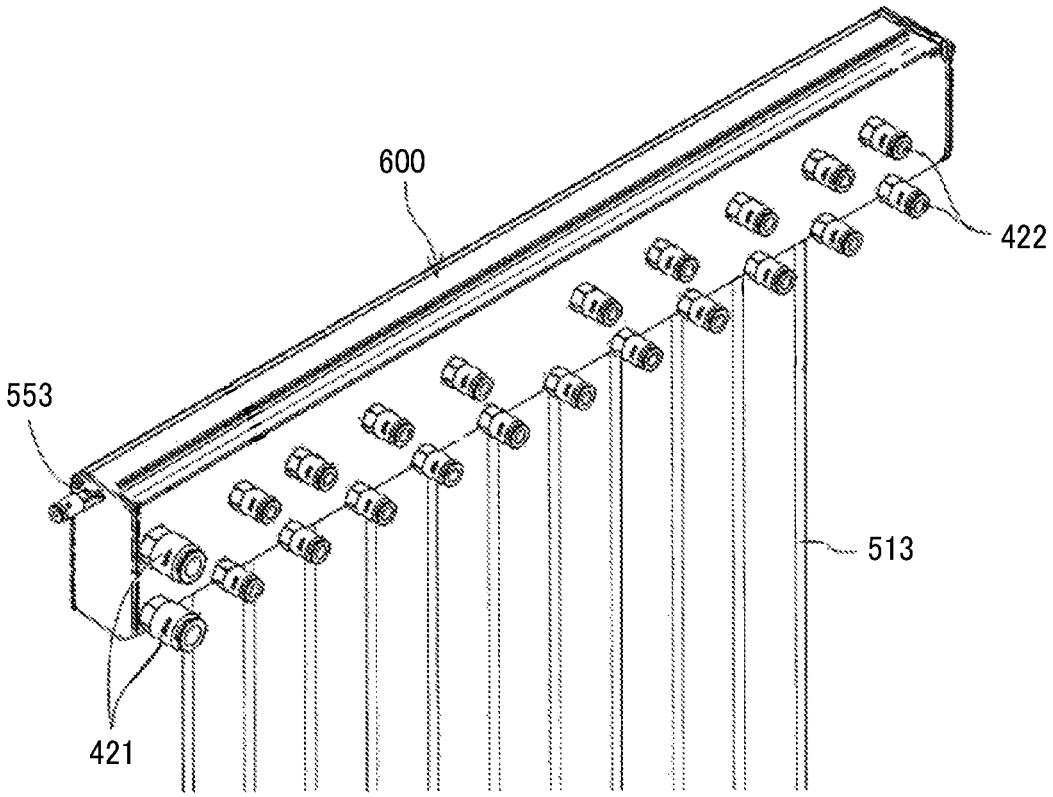
FIG. 20 is a perspective view of a manifold according to a fourth embodiment.

A fourth embodiment of the present disclosure is described with reference to FIGS. 20 and 21. FIG. 20 is a perspective view of a manifold according to the fourth embodiment, and FIG. 21 is a cross-sectional view of the manifold.

In the present embodiment, the temperature-controlled liquid supply manifold 505 and the ink supply manifold 402 described in the above embodiment are integral in a manifold 600. In other words, the manifold 600 is a member that distributes and supplies the liquid (ink) and the temperature-controlled liquid 510 to the plurality of heads 100.

In a body of the manifold 600, the temperature-controlled liquid channel 551 (the liquid channels 551*a* to 551*d*) that are second liquid channels through which the temperature-controlled liquid 510 flows and the ink supply channel 420 that is a first liquid channel through which ink flows are formed. The temperature-controlled liquid channel 551 is coupled to the temperature-controlled liquid supply port 132 of each head 100 by the supply passage 513 such as a tube. The ink supply channel 420 is coupled to each head 100 through the outlet port 422.

Figure 21:
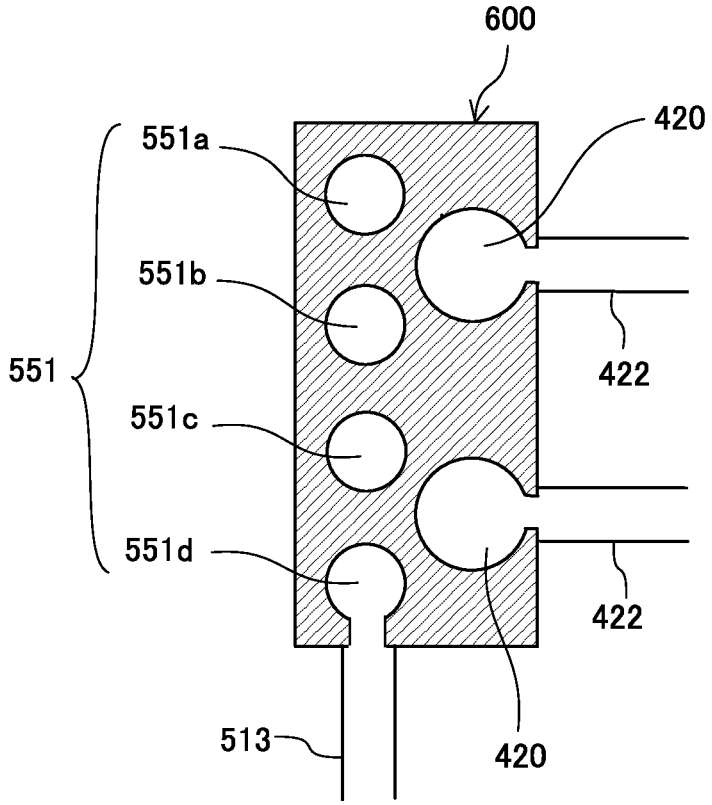
FIG. 21 is a cross-sectional view illustrating the manifold illustrated in FIG. 20.

As illustrated in FIG. 21, the ink supply channel 420 is preferably disposed between the two of the liquid channels 551*a* to 551*d* through which the temperature-controlled liquid 510 flows.

Also in the present embodiment, the temperature-controlled liquid channels 551 and the ink supply channel 420 are thermally coupled. Accordingly, the ink temperature can be adjusted before the ink is supplied to the plurality of heads 100, thereby reducing temperature changes (temperature gradient) of the ink supplied to the heads 100. This reduces variations in the ink discharge properties of the heads 100.

The manifold 600 in which the temperature-controlled liquid supply manifold 505 and the ink supply manifold 402 are integrated as in the present embodiment can be easily modeled by, for example, a three-dimensional (3D) fabricating apparatus (i.e., a 3D printer).

In the present embodiment, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs an electrothermal transducer element, such as a heat element, and an electrostatic actuator including a diaphragm and opposed electrodes.

Examples of the liquid discharge apparatus include, not only apparatuses capable of discharging liquid to materials to which liquid can adhere, but also apparatuses to discharge a liquid toward gas or into a liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers to form a three-dimensional fabricated object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the liquid discharge head and a material onto which liquid can adhere. However, the liquid discharge apparatus is not limited to such an apparatus. For example, the liquid discharge apparatus may be a serial head apparatus that moves the liquid discharge head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation," "recording," "printing," "image printing," and "fabricating" used herein can be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a plurality of heads configured to discharge a liquid;

a liquid supply manifold configured to distribute the liquid to the plurality of heads; and a temperature-controlled liquid supply manifold configured to supply a temperature-controlled liquid to the plurality of heads and thermally coupled to the liquid supply manifold, wherein a flow speed of the temperature-controlled liquid is faster than a flow speed of the liquid in discharging the liquid at a maximum discharge amount from the plurality of heads.

2. The liquid discharge apparatus according to claim 1, wherein the temperature-controlled liquid supply manifold includes a fitting portion configured to fit with the liquid supply manifold.

3. The liquid discharge apparatus according to claim 1, wherein the temperature-controlled liquid supply manifold includes a temperature-controlled liquid channel in which a plurality of channels is folded back and connected to each other.

4. The liquid discharge apparatus according to claim 1, further comprising:

a circulation passage configured to circulate the temperature-controlled liquid through the plurality of heads;

a cooler configured to cool the temperature-controlled liquid, the cooler being in the circulation passage; and a heater configured to heat the temperature-controlled liquid, the heater being in the circulation passage.

5. The liquid discharge apparatus according to claim 4, further comprising:

a sensor configured to detect a temperature of the temperature-controlled liquid; and control circuitry configured to:

heat, with the heater, the temperature-controlled liquid when the temperature of the temperature-controlled liquid detected by the sensor is lower than a threshold temperature; and cool, with the cooler, the temperature-controlled liquid when the temperature of the temperature-controlled liquid detected by the sensor is equal to or higher than the threshold temperature.

6. The liquid discharge apparatus according to claim 4, wherein the cooler, the heater, the temperature-controlled liquid supply manifold, and the plurality of heads are in this order in a direction of flow of the temperature-controlled liquid in the circulation passage.

7. The liquid discharge apparatus according to claim 1, wherein a circulation amount per unit time of the temperature-controlled liquid is greater than a supply amount per unit time of the liquid, the supply amount being equivalent to a maximum discharge amount of the liquid by the plurality of heads.

8. The liquid discharge apparatus according to claim 1, wherein each of the plurality of heads includes:

a first liquid channel through which the liquid flows; and a second liquid channel through which the temperature-controlled liquid flows, the second liquid channel thermally coupled to the first liquid channel inside each of the plurality of heads.

9. The liquid discharge apparatus according to claim 1, further comprising a temperature-controlled liquid collection manifold configured to collect the temperature-controlled liquid from the plurality of heads.

10. The liquid discharge apparatus according to claim 9, further comprising a plurality of temperature-controlled liquid passages each of which connecting one of the plurality of heads to an outlet port of the temperature-controlled liquid supply manifold and an inlet port of the temperature-controlled liquid collection manifold, wherein a distance from the outlet port of the temperature-controlled liquid supply manifold via one of the plurality of heads to the inlet port of the temperature-controlled liquid collection manifold is equal among the plurality of temperature-controlled liquid passages.

11. The liquid discharge apparatus according to claim 9, wherein the liquid supply manifold, the temperature-controlled liquid supply manifold, and the temperature-controlled liquid collection manifold are above the plurality of heads.

12. The liquid discharge apparatus according to claim 9, further comprising a circulation passage configured to circulate the temperature-controlled liquid in an order of the temperature-controlled liquid supply manifold, one of the plurality of heads, another one of the plurality of heads, and the temperature-controlled liquid collection manifold.

13. The liquid discharge apparatus according to claim 1, wherein the liquid supply manifold and the temperature-controlled liquid supply manifold are integral with each other.

14. A liquid discharge apparatus comprising:

a plurality of heads configured to discharge a liquid; and a manifold configured to distribute the liquid and a temperature-controlled liquid to the plurality of heads, wherein a flow speed of the temperature-controlled liquid is faster than a flow speed of the liquid in discharging the liquid at a maximum discharge amount from the plurality of heads.

15. A liquid discharge apparatus comprising:

a plurality of heads configured to discharge a liquid;

a first liquid channel through which the liquid is distributed to the plurality of heads; and a second liquid channel configured to distribute a temperature-controlled liquid to the plurality of heads and thermally coupled to the first liquid channel, wherein a flow speed of the temperature-controlled liquid is faster than a flow speed of the liquid in discharging the liquid at a maximum discharge amount from the plurality of heads.

* * * * *